US010648220B2

(12) United States Patent
De Maeyer et al.

(10) Patent No.: US 10,648,220 B2
(45) Date of Patent: May 12, 2020

(54) ELONGATE PROFILED FRAME ELEMENT

(71) Applicant: Deceuninck NV, Hooglede-Gits (BE)

(72) Inventors: Erik De Maeyer, Hooglede-Gits (BE); Peter Degrande, Hooglede-Gits (BE)

(73) Assignee: Deceuninck NV, Hooglede-Gits (BE)

( * ) Notice: Subject to any disclaimer, the term of this patent is extended or adjusted under 35 U.S.C. 154(b) by 0 days.

(21) Appl. No.: 15/557,038

(22) PCT Filed: Mar. 9, 2016

(86) PCT No.: PCT/EP2016/055038
§ 371 (c)(1),
(2) Date: Sep. 8, 2017

(87) PCT Pub. No.: WO2016/142429
PCT Pub. Date: Sep. 15, 2016

(65) Prior Publication Data

US 2018/0058137 A1 Mar. 1, 2018

(30) Foreign Application Priority Data

Mar. 9, 2015 (EP) ..... 15158265

(51) Int. Cl.
*E06B 3/22* (2006.01)
*E06B 3/58* (2006.01)
*E06B 3/263* (2006.01)

(52) U.S. Cl.
CPC ..... *E06B 3/222* (2013.01); *E06B 3/5842* (2013.01); *E06B 2003/224* (2013.01); *E06B 2003/26332* (2013.01)

(58) Field of Classification Search
CPC ..... E06B 3/222; E06B 3/5842; E06B 2003/26332; E06B 2003/224; E06B 3/221;

(Continued)

(56) References Cited

U.S. PATENT DOCUMENTS 3,334,463 A * 8/1967 Muessel ..... E06B 3/5857 52/656.2
4,640,078 A * 2/1987 Haffer ..... E06B 3/222 49/DIG. 1

(Continued)

FOREIGN PATENT DOCUMENTS

DE 196 32 048 2/1998
DE 103 19 747 11/2004

OTHER PUBLICATIONS

Aluplast RC2N standard, online page, "Security and burglary resistance," www.aluplast.net, (Printed) Oct. 19, 2018.

(Continued)

*Primary Examiner* — Joshua J Michener
*Assistant Examiner* — Matthew J Gitlin
(74) *Attorney, Agent, or Firm* — Levy & Grandinetti

(57) ABSTRACT

The present invention is directed to a construction profile for a window or door frame, the profile manufactured in a plastics material and comprising: —a main body extending in a longitudinal direction X; —one fixed and one removable clamping bracket, both clamping brackets protruding from said main body in direction Y perpendicular to the longitudinal direction X, and extending parallel to one another and at a distance of one another in the longitudinal direction X; —a pane receiving zone defined by, on the one hand, said clamping brackets and, on the other hand, a surface of said main body, the receiving zone configured to receive a side edge of a pane (the pane extending in the X-Y plane) to be clamped between said clamping brackets, —the fixed clamping bracket comprising a hollow body having at least two side walls, one facing the pane receiving zone and one facing away the pane receiving zone and defining an upper free end portion (configured to abut a pane received in the pane receiving zone) and a base portion joining the upper free end portion to the main body, characterized in that the (Continued)

distance between said side walls of the fixed clamping bracket progressively widens at its base portion from the upper portion towards the main body. Further, the present invention is also directed to a window or door comprising a frame with at least one construction profile as defined above, the window or door having a Resistance Class RC 2 N according to the DIN V ENV 1627/2011 standard.

16 Claims, 3 Drawing Sheets

(58) Field of Classification Search
CPC ..... E06B 2003/228; E06B 2003/26327; E06B 2003/225; E06B 2003/4461; E06B 3/26303; E06B 3/4609; E06B 7/2305
USPC ..... 52/309.16, 309.15, 656.1, 656.2, 204.53, 52/730.3, 730.4, 734.2, 730.1, 731.1, 52/731.2, 732.2; 49/DIG. 2
See application file for complete search history.

(56) References Cited

U.S. PATENT DOCUMENTS 4,944,118 A * 7/1990 Biro ..... E06B 3/44 49/504
5,339,583 A * 8/1994 Hrdlicka ..... E06B 3/302 156/293
5,687,518 A * 11/1997 Endo ..... E06B 3/10 49/501
6,003,277 A * 12/1999 Graham ..... B29C 44/22 49/504
6,792,724 B2 * 9/2004 Burgess ..... E06B 3/685 49/50
6,848,225 B2 * 2/2005 Lapierre ..... E06B 7/14 52/204.53
7,775,003 B2 * 8/2010 Sabac ..... G03B 17/26 52/204.53
8,828,171 B2 * 9/2014 Wust ..... E06B 3/221 156/244.13
2002/0059759 A1 5/2002 Bielefeld et al.
2003/0089054 A1 * 5/2003 Hornung ..... E06B 3/24 52/204.62
2005/0246980 A1 * 11/2005 Montero ..... E06B 3/5821 52/204.53
2006/0143996 A1 * 7/2006 Alvarado ..... E06B 1/02 52/204.53
2009/0313941 A1 * 12/2009 Siodla ..... E06B 3/26303 52/800.13
2010/0083597 A1 * 4/2010 Addison ..... E06B 3/303 52/204.53
2010/0186339 A1 * 7/2010 Gierszewski ..... E05C 9/004 52/656.2
2017/0030139 A1 * 2/2017 Rebree ..... E06B 3/221

OTHER PUBLICATIONS

SITEC GmbH RC2 standard, online pages, "Burglar Resistance," www.sitec.de, 2016.

* cited by examiner

FIG 1- prior art

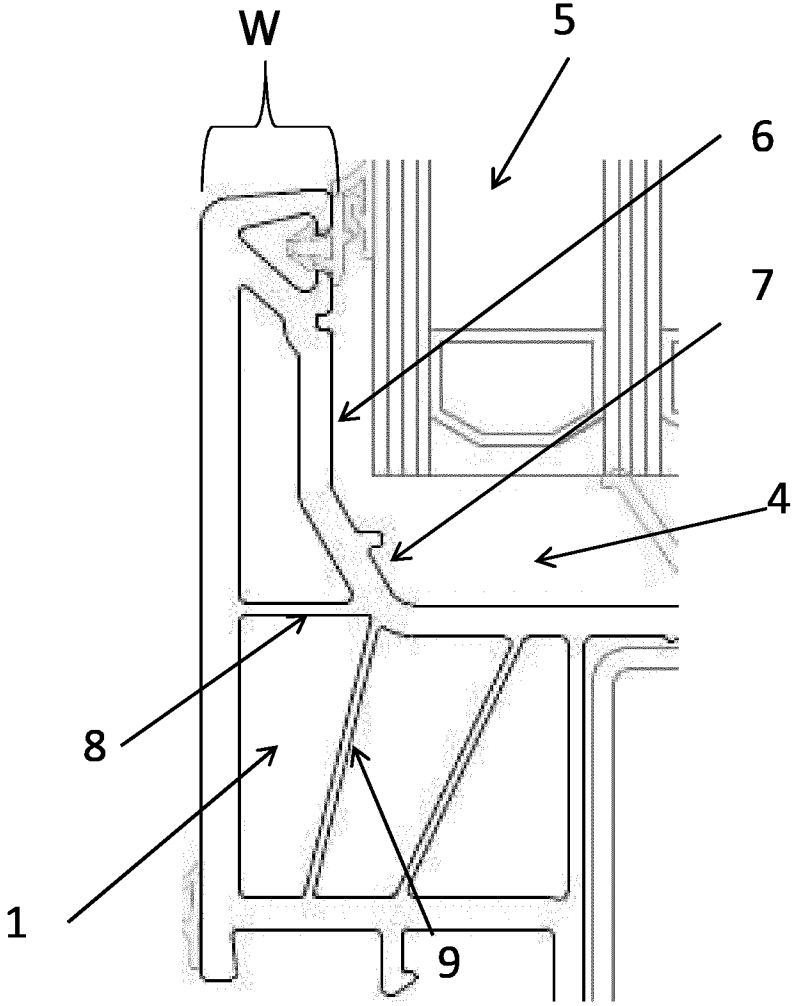
FIG 3
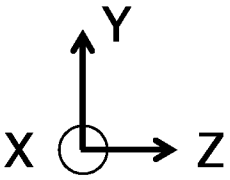

ELONGATE PROFILED FRAME ELEMENT

FIELD OF THE INVENTION

The present invention relates to a construction profile for a window or door frame, the profile manufactured in a plastics material. In addition, it relates a window or door comprising a frame with at least one such construction profile.

BACKGROUND

State-of-the-art plastic window assemblies comprise a frame formed from a number of elongate plastic construction profiles connected together at the corners of the frame. Such construction profile is shaped to provide a receiving zone for receiving a marginal portion of a side edge of a pane and two clamping brackets engaging on the marginal portions of the pane for securing its position. The clamping brackets may be both fixed being an integral part of the elongate construction profiles. Alternatively, the construction profile may be shaped providing a fixed clamping bracket and a channel for receiving a removable clamping bracket. After installing the pane in the receiving zone, the removable clamping bracket is mounted in the channel.

An example of a state-of-the-art plastic construction profile shaped providing a fixed clamping bracket and a channel for receiving a removable clamping bracket is described in DE19632048.

As can be seen from FIG. 1, such fixed clamping bracket (PA1) is relatively wide in cross-section (PA2) perpendicular to the X-Y plane. Typical dimensions are 15 to 25 mm. These dimensions are necessary for giving the bracket sufficient strength, in particular for putting sufficient pressure on the pane achieving a waterproof and wind tight connection between the clamping bracket and the pane, also for achieving sufficient thermal stability and mechanical stability, and further for resisting load and torsion load on the bracket caused by wind load on the pane.

It is a general problem that construction profiles having clamping brackets with relatively wide cross-section do not allow the manufacturing of window assemblies with less pronounced construction profiles with respect to the window in its totality, let alone window assemblies meant for being mounted in a (partially) sunken configuration, i.e. with construction profiles that are partially or completely hidden in the wall cavity.

Considering the above, it is an object of the present invention to provide a plastic construction profile having a shallow fixed clamping bracket allowing manufacturing more minimalistic windows yet without jeopardizing strength of the profile and window assembly.

SHORT DESCRIPTION OF THE DRAWINGS

FIG. 3 provides a detailed view of an embodiment of a plastic construction profile for a window or door frame in accordance with the present invention.

SUMMARY OF THE INVENTION

The present invention is directed to a construction profile for a window or door frame, the profile manufactured in a plastics material and comprising:

- a main body extending in a longitudinal direction X;
- one fixed and one removable clamping bracket, both clamping brackets protruding from said main body in direction Y perpendicular to the longitudinal direction X, and extending parallel to one another and at a distance of one another in the longitudinal direction X;
- a pane receiving zone defined by, on the one hand, said clamping brackets and, on the other hand, a surface of said main body, the receiving zone configured to receive a side edge of a pane (the pane extending in the X-Y plane) to be clamped between said clamping brackets,
- the fixed clamping bracket comprising a hollow body having at least two side walls, one facing the pane receiving zone and one facing away the pane receiving zone and defining an upper free end portion (configured to abut a pane received in the pane receiving zone) and a base portion joining the upper free end portion to the main body,
- characterized in that the distance between said side walls of the fixed clamping bracket progressively widens at its base portion from the upper portion towards the main body.

Further, the present invention is also directed to a window or door comprising a frame with at least one construction profile as defined above, the window or door having a Resistance Class RC 2 N according to the DIN V ENV 1627/2011 standard.

DETAILED DESCRIPTION

Figure 1:
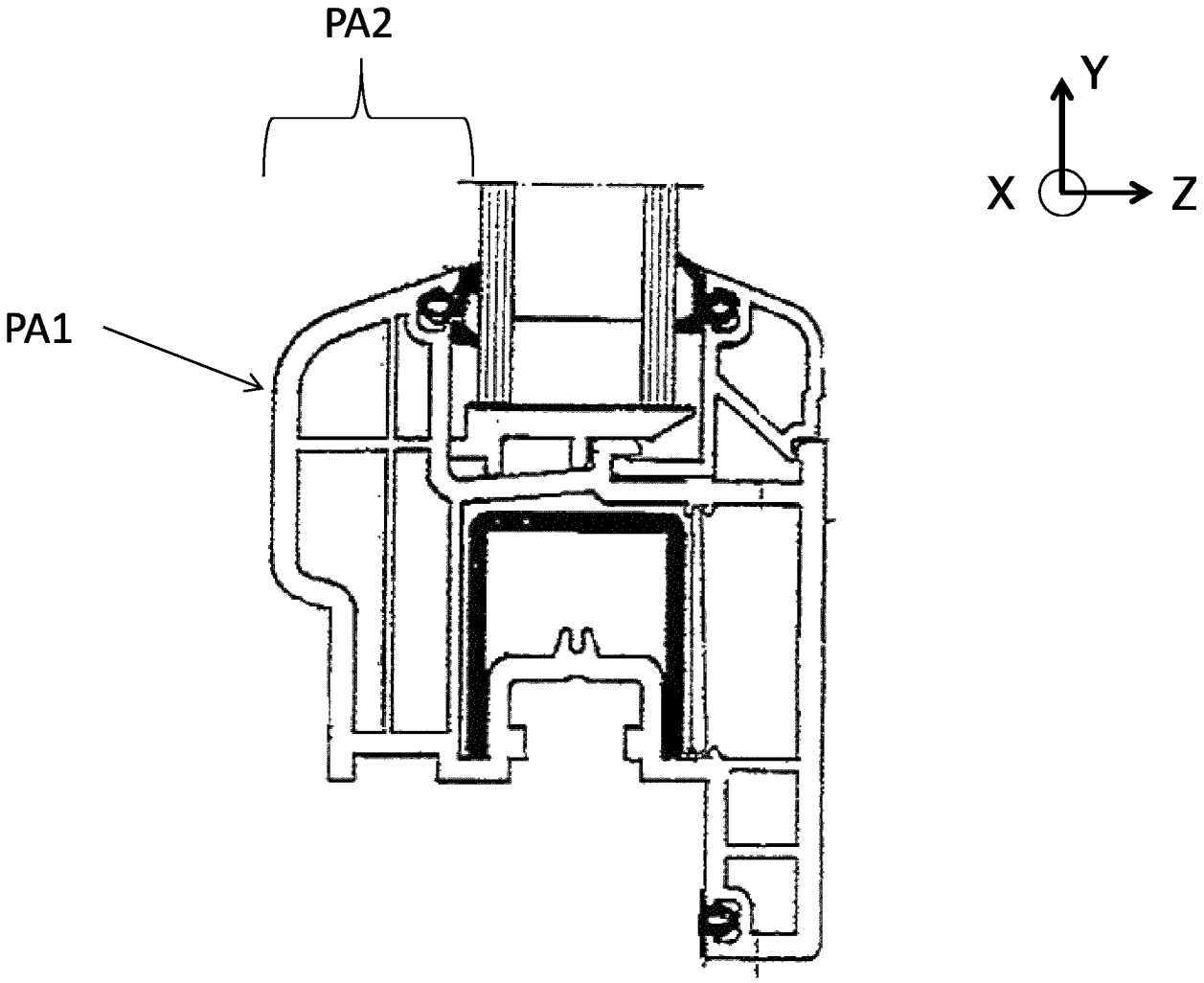
FIG. 1 illustrates a state-of-the-art plastic construction profile for a window or door frame.
Figure 2:
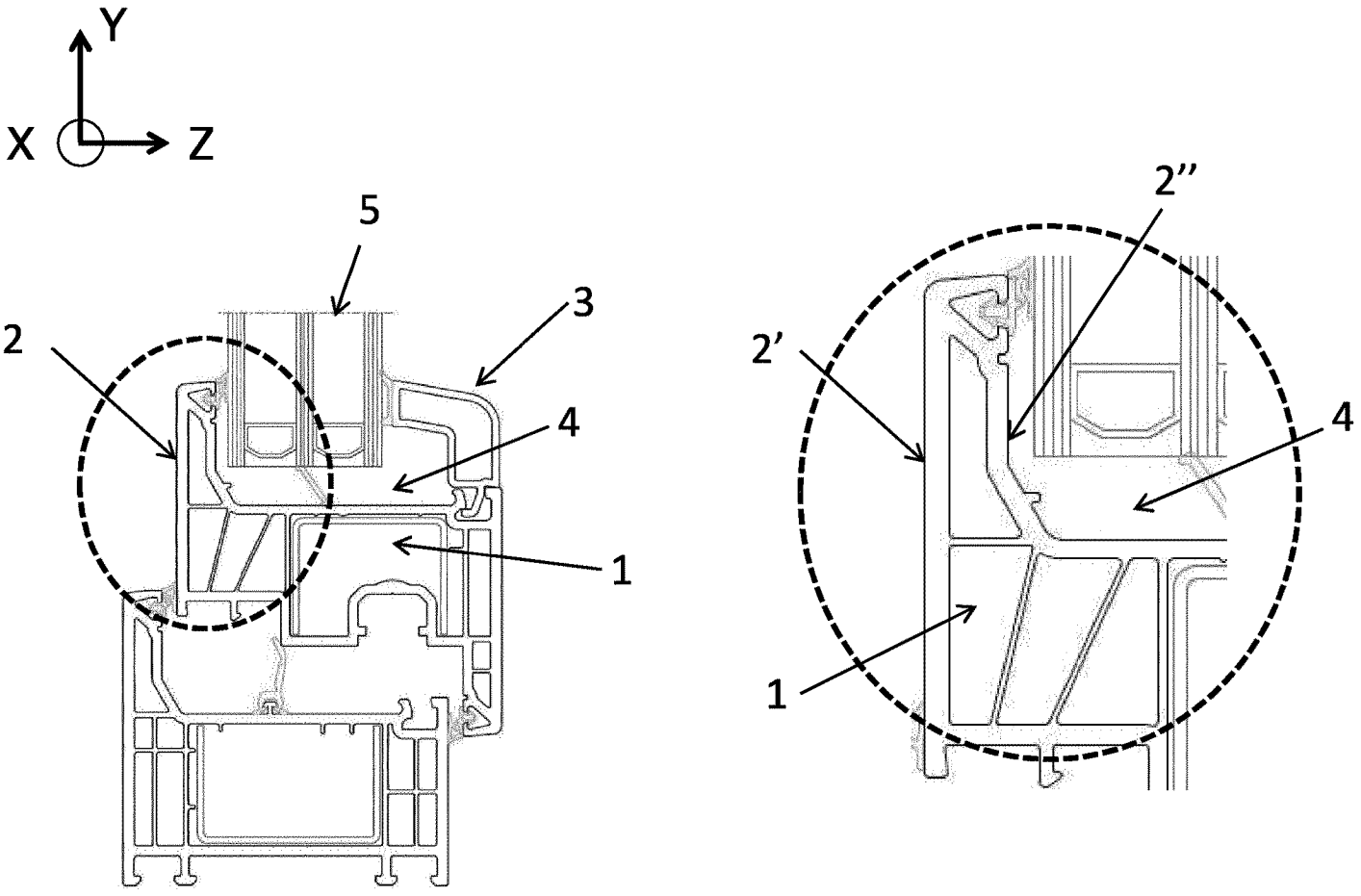
FIG. 2 illustrates an embodiment of a plastic construction profile for a window or door frame in accordance with the present invention.

As a first embodiment in accordance with the present invention and as illustrated in FIG. 2, a construction profile for a window or door frame is provided, the profile manufactured in a plastics material and comprising:

- a main body (1) extending in a longitudinal direction X;
- one fixed (2) and one removable (3) clamping bracket, both clamping brackets protruding from said main body in direction Y perpendicular to the longitudinal direction X, and extending parallel to one another and at a distance of one another in the longitudinal direction X;
- a pane receiving zone (4) defined by, on the one hand, said clamping brackets and, on the other hand, a surface of said main body, the receiving zone configured to receive a side edge of a pane (5) (the pane extending in the X-Y plane) to be clamped between said clamping brackets,
- the fixed clamping bracket comprising a hollow body having at least two side walls (2', 2"), one facing the pane receiving zone (2") and one facing away the pane receiving zone (2') and defining an upper free end portion (configured to abut a pane received in the pane receiving zone) and a base portion joining the upper free end portion to the main body,
- characterized in that the distance between said side walls (2', 2") of the fixed clamping bracket progressively widens at its base portion from the upper portion towards the main body (1).

By progressively widening the distance between the sidewalls towards the main body, the fixed clamping bracket may be manufactured with smaller cross-section width, measured perpendicular to the X-Y plane, compared to state of the art plastic construction profiles, while still enabling putting sufficient pressure on the pane for achieving a waterproof and wind tight connection between the clamping bracket and the pane, and still providing sufficient thermal stability and mechanical stability.

In an embodiment, the distance between said side walls (2', 2") of the fixed clamping bracket may progressively widen at its base portion from the upper portion towards the main body (1) by extending the side wall facing the pane receiving zone slantingly inwards the pane receiving zone (4) towards that main body surface.

In an embodiment in accordance with the present invention as illustrated in FIG. 3, the side wall of the fixed clamping bracket facing the pane receiving zone may comprises a first section (6) at the upper portion extending in a plane generally parallel to the X-Y plane and a second section (7) connecting the first section to the surface of the main body defining the pane receiving zone, said second section extending slantingly inwards the pane receiving zone (4) towards that main body surface.

In a particular embodiment, the upper portion of the fixed clamping bracket may have a width W—measured in a direction perpendicular to the X-Y plane, of maximally 12 mm, or maximally 10 mm, preferably maximally 9 mm; and preferably a height (measured in the Y-direction from the surface of the main body delimiting the pane receiving zone to the free end of the fixed clamping bracket) over maximum width ratio of more than 2.0, preferably more than 3.0, most preferably more than 3.2.

Thanks to the inwardly slanting side wall (7) at the clamping bracket's second section, the upper portion may be of limited width without losing strength. This results in that a plastic construction profile may be obtained having a shallow fixed clamping bracket allowing manufacturing more minimalistic windows without jeopardizing strength of the profile and window assembly.

In an embodiment in accordance with the present invention, the fixed clamping bracket may have a load deflection characteristic in a direction perpendicular to the X-Y plane from inside the pane receiving zone to outwards said zone of less than 0.8 mm, preferably less than 0.7 mm, or even more preferably less than 0.65 mm (measured at the top) for a deflection load of at least 80N/100 mm, or even for a deflection load of at least 100N/100 mm.

By making the distance between the side walls (2', 2") of the fixed clamping bracket progressively widening at its base portion from the upper portion towards the main body (1), load deflection characteristics (measured at the top) may improve with at least 10%, even at least 15% compared to the load deflection characteristics of the same clamping bracket with parallel side walls.

The main body (1) of the construction profile comprises a hollow body delimited by side walls. This main body may be compartmented by inner walls in order to improve its strength and insulation characteristics. At least one inner wall thereof may extend from said second section of the side wall of the fixed clamping bracket facing the pane receiving zone in a direction perpendicular to the plane wherein said second section extends. More preferably and as also illustrated by FIG. 3, at least two inner walls (8 and 9) may extend from said second section (7) of the side wall of the fixed clamping bracket facing the pane receiving zone such that said inner side walls define a vector in a direction perpendicular to the plane wherein said second section extends. Such vector configuration provides support to the second section and helps avoiding deformation of the second section upon load, thereby increasing the overall load resistance of the fixed clamping bracket and improving keeping sufficient pressure on the pane for achieving a waterproof and wind tight connection.

Whereas conventional plastic construction profile often require an additional reinforcement profile or add-on positioned in or against the side wall of the fixed clamping bracket facing the pane receiving zone, a construction profile according to any of the above embodiments may not. This Is particularly the case for embodiments of the present invention wherein the side wall of the main body delimiting the pane receiving zone extends in a X-Z plane and, at least in the vicinity of the contact between this side wall and the base portion of the fixed clamping bracket, extends at a constant level (flat in the X-Z plane) and preferably at a level higher than (closer to the free end of the fixed clamping bracket) or at the same level as the remainder of said side wall. In other words, the base portion of the fixed clamping bracket preferably meets the surface of the main body at the shallowest (less depth) part of the pane receiving zone, meaning that no 'drainage' channel is provided at the interface of the main body and the fixed clamping bracket. Clearly the base portion of the clamping bracket is to be understood as not reaching to a level below the level of the side wall of the main body delimiting the pane receiving zone.

In case no drainage channel is provided in the pane receiving zone, it is preferred to provide a sealing on the side wall of the main body, reaching upwards in the Y-direction to contact the pane provided in the pane receiving zone.

Further, a construction profile in accordance with the present invention may be used as window frame profile or door frame profile of any type, and in particular as a window wing profile.

In addition, the present invention is further directed to a window or door comprising a frame with at least one plastic construction profile as defined above, the window or door having a Resistance Class RC 2 N according to the DIN V ENV 1627/2011 standard.

Such window or door may have at least one frame side of a dimension of 0.5 m, or 1 m, or 1.5 m or more.

The present invention may also provide a window or door comprising a frame formed from a plurality of elongate plastic construction profiles as described above.

Whereas a conventional window or door comprising a frame formed conventional plastic construction profile often require an additional reinforcement profile or add-on positioned in or against the side wall of the fixed clamping bracket facing the pane receiving zone, a window or door formed from construction profiles according to any of the above embodiments may not.

In an embodiment of a window or door in accordance with the present invention, the pane side edge may be clamped between the clamping brackets such that the pane side edge surface is positioned at a distance from the surface (4) of the main body defining the pane receiving zone.

The window or door may have a depth dimension measured in a direction Z perpendicular to the X-Y plane, such that the pane is clamped in position by the clamping brackets whereby the surface of the pane (5) facing the fixed clamping bracket at least partially overlaps with the base portion (7) of the fixed clamping bracket in the depth direction.

In a window or door using the plastic construction profile as described in the above embodiments, the surface of the pane facing the outer surface of the window or door profile may be positioned at a distance of maximally 12 mm, preferably maximally 11 mm, most preferably maximally 10 mm measured in the depth direction, from the outer surface of the window or door profile.

Further, the present invention also provides a set of parts for constructing a window assembly comprising one or more elongate plastic construction profiles as described above, or one or more lengths of elongate profile frame material from which such elements may be cut, and an equal number of removable clamping brackets or one or more lengths of clamping bracket material from which such clamping brackets may be cut.

As illustrated in FIG. 2, a sealing strip is provided at the free end of the fixed clamping bracket, facing the pane positioned in the pane receiving zone. This sealing strip preferably is configured to contact the glass pane at a level as close as possible to the main body, preferably at approximately two third of the height of the fixed clamping bracket or lower, such as to limit the momentum of the pressure exerted by the pane on the fixed bracket.

The above description of the construction profile is primarily directed at a window profile, however the same is valid for sash profiles, wherein the pane receiving zone of the window profile corresponds to the window receiving zone of the sash.

The invention claimed is:

1. A construction profile for a window or door frame, the profile manufactured in a plastics material and comprising:

a main body extending in a longitudinal direction X, the main body comprising a hollow body delimited by side walls and compartmented by inner walls;

one fixed and one removable clamping bracket, both clamping brackets protruding from said main body in direction Y perpendicular to the longitudinal direction X and extending parallel to one another and at a distance from one another in the longitudinal direction X;

a pane receiving zone defined by said clamping brackets and a surface of said main body, the receiving zone configured to receive a side edge of a pane, wherein the pane extends in an X-Y plane and is to be clamped between said clamping brackets; and the fixed clamping bracket comprises a hollow body having at least two side walls, one facing the pane receiving zone and one facing away from the pane receiving zone and defining an upper free end portion which is configured to abut a pane received in the pane receiving zone, and a base portion joining the upper free end portion to the main body, the side wall of the fixed clamping bracket facing the pane receiving zone comprising a first section at the upper portion extending in a plane parallel to the X-Y plane and a second section connecting the first section to the surface of the main body defining the pane receiving zone, said second section extending slantingly inwards towards the main body surface;

a distance between two of said side walls of the fixed clamping bracket progressively widens at its base portion from the upper portion towards the main body;

characterized in that the main body comprises at least two inner walls extending from said second section of the side wall of the fixed clamping bracket facing the pane receiving zone such that said inner walls provide a total angle between the at least two inner walls, and wherein an angle which bisects said total angle extends in a direction perpendicular to the second section, thereby providing support and helping avoid deformation of the second section upon load, as such increasing the overall load resistance of the fixed clamping bracket.

2. The construction profile according to claim 1, wherein the upper portion of the fixed clamping bracket has a width W-measured in a direction perpendicular to the X-Y plane, of maximally 12 mm.

3. The construction profile according to claim 1, wherein the fixed clamping bracket has a load deflection characteristic in a direction perpendicular to the X-Y plane from inside the pane receiving zone to outwards said zone of less than 0.8 mm, as measured at the top, for a deflection load of at least 80N/100 mm.

4. The construction profile according to claim 1, free from an additional reinforcement profile or add-on positioned in or against the side wall of the fixed clamping bracket facing the pane receiving zone.

5. The construction profile according to claim 1, wherein said construction profile is a window wing profile.

6. The construction profile according to claim 1, wherein a side wall of the main body delimiting the pane receiving zone extends in an X-Z plane and, at least in a vicinity of the contact between this side wall and the base portion of the fixed clamping bracket, extends at a constant level.

7. The construction profile according to claim 1, wherein the fixed clamping bracket having a height, as measured in the Y-direction from the surface of the main body delimiting the pane receiving zone to the free end of the fixed clamping bracket, over a maximum width ratio of more than 2.0.

8. A window or door comprising a frame with at least one construction profile as defined in claim 1, the window or door having a Resistance Class RC 2 N according to the DIN V ENV 1627/2011 standard.

9. The window or door according to claim 8 having at least one frame side of a dimension of 1 m or more.

10. The window or door according to claim 8, free from an additional reinforcement profile or add-on positioned in or against the side wall of the fixed clamping bracket facing the pane receiving zone.

11. The window or door according to claim 8, wherein a pane side edge is clamped between the clamping brackets such that the pane side edge surface is positioned at a distance from the surface of the main body defining the pane receiving zone.

12. The window or door according to claim 8, wherein the window or door has a depth dimension measured in a direction Z perpendicular to the X-Y plane, the pane being clamped in position by the clamping brackets whereby a surface of the pane facing the fixed clamping bracket at least partially overlaps with the base portion of the fixed clamping bracket in the depth direction.

13. The construction profile according to claim 1, wherein the fixed clamping bracket has a load deflection characteristic in a direction perpendicular to the X-Y plane from inside the pane receiving zone to outwards said zone of less than 0.8 mm, as measured at the top, for a deflection load of at least 80N/100 mm.

14. The construction profile according to claim 13, wherein the main body comprises a hollow body delimited by side walls and compartmented by inner walls, comprising at least one inner wall extending from said second section of the side wall of the fixed clamping bracket facing the pane receiving zone in a direction perpendicular to a plane wherein said second section extends.

15. The construction profile according to claim 14, wherein the main body comprises a hollow body delimited by side walls and compartmented by inner walls, comprising at least two inner walls extending from said second section of the side wall of the fixed clamping bracket facing the pane receiving zone such that said inner walls extend in a direction perpendicular to the second section.

16. A window or door comprising a frame with at least one construction profile as defined in claim 15, the window or door having a Resistance Class RC 2 N according to the DIN V ENV 1627/2011 standard.

* * * * *